United States Patent [19]

Post

[11] 4,420,283

[45] Dec. 13, 1983

[54] METHOD OF FORMING AN OUTWARDLY INVERTED PERIPHERAL EDGE ON A PREFORMED METAL LID

[75] Inventor: Willem P. Post, Diepenveen, Netherlands

[73] Assignee: Thomassen & Drijver-Verblifa N.V., Deventer, Netherlands

[21] Appl. No.: 304,646

[22] Filed: Sep. 23, 1981

[30] Foreign Application Priority Data

Sep. 29, 1980 [NL] Netherlands ..... 8005402

[51] Int. Cl.[3] ..... B21D 51/26

[52] U.S. Cl. ..... 413/8; 413/56; 72/354

[58] Field of Search ..... 413/1, 8, 11, 56, 62; 72/379, 354, 348, 411

[56] References Cited

U.S. PATENT DOCUMENTS 1,567,387 12/1925 Rode .
1,766,098 6/1930 Booth ..... 72/354
1,803,022 4/1931 Kowal .
1,888,397 11/1932 Slick .
2,144,701 1/1939 Campbell et al. ..... 29/509

FOREIGN PATENT DOCUMENTS 407329 12/1909 France .
661638 11/1951 United Kingdom .

*Primary Examiner*—Francis S. Husar
*Assistant Examiner*—David B. Jones
*Attorney, Agent, or Firm*—Diller, Ramik & Wight

[57] ABSTRACT

The invention relates to a method whereby a preformed metal lid which is intended for a tin, e.g. a paint tin, and of which at least one peripheral portion is axially deepened, is formed with a radially outwardly inverted peripheral edge with respect to the lid axis. The object of this invention is to provide a method in which the outwardly inverted peripheral edge can be formed with very close dimensional tolerances. To this end the invention provides a method of the type referred to hereinbefore, which is characterized in that the lid is held in tightly fitting relationship in all directions in a multipart die at least by its deepened peripheral portion, except in the zone where the inverted peripheral edge is to be formed and at least at the inside of the base of said peripheral portion, and said base is pressed by art of the die acting as a punch against the part of the die situated opposite the inside of the base.

1 Claim, 6 Drawing Figures

FIG. 3
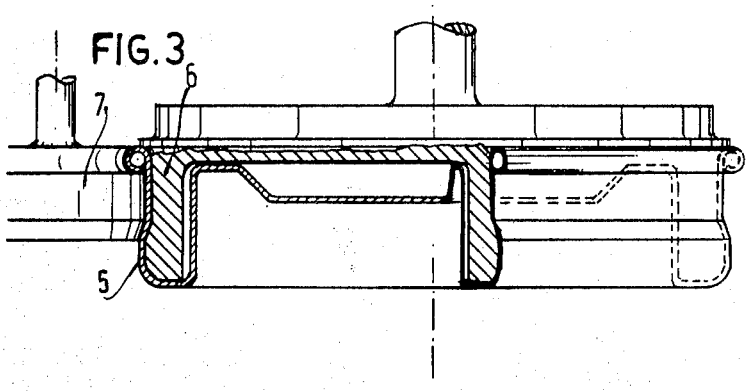
FIG. 4
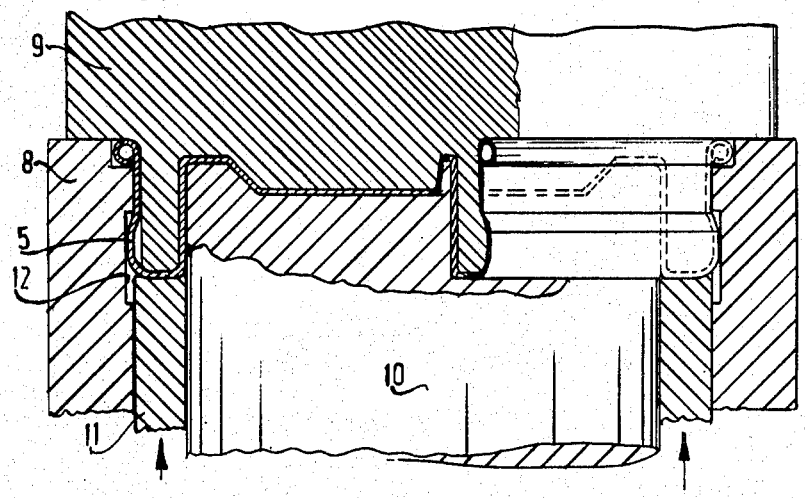
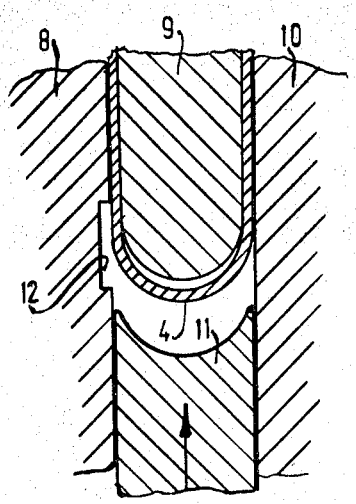
FIG. 5
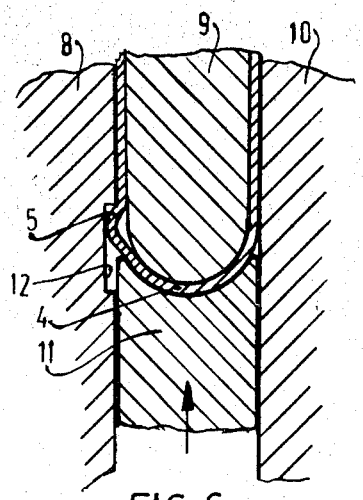
FIG. 6

METHOD OF FORMING AN OUTWARDLY INVERTED PERIPHERAL EDGE ON A PREFORMED METAL LID

This invention relates to a method whereby a pre-formed metal lid which is intended for a tin, e.g. a paint tin, and of which at least one peripheral portion is axially deepened, is formed with a radially outwardly inverted peripheral edge with respect to the lid axis. In a known method of this type, the pre-formed metal lid is placed loosely on a rotatable mandrel, the shape of which is selected according to the outwardly inverted peripheral edge to be formed on the lid, whereupon rotation of the mandrel and pressing of an at least partly matchingly shaped roller against the rotating lid forms the inverted peripheral edge. In this roll-forming operation the lid is placed loosely on the mandrel. If it were to fit very tightly around the mandrel problems would arise in respect of releasing the finally formed lid after the inverted edge is formed.

As a result of the lid resting loosely on the mandrel in this way, only the side of the tin facing the roller comes into intimate contact with the mandrel.

Another disadvantage of the known roll-forming operation is that the metal yield point is frequently exceeded.

Owing to the loose contact between the lid and the mandrel, and the yield point of the metal being exceeded during the roll-forming operation, it is impossible to control the dimensions and the roundness of the peripheral edge. Lids formed in this way have a distinct preferential direction, resulting in an oval shape to some extent. As a result of this oval shape, once a tin has been opened it is relatively difficult to re-seal it with optimum sealing-tightness.

The object of this invention is to provide a method in which the outwardly inverted peripheral edge can be formed with very close dimensional tolerances. To this end the invention provides a method of the type referred to hereinbefore, which is characterised in that the lid is held in tightly fitting relationship in all directions in a multi-part die at least by its deepened peripheral portion, except in the zone where the inverted peripheral edge is to be formed and at least at the inside of the base of said peripheral portion, and said base is pressed by part of the die acting as a punch against the part of the die situated opposite the inside of the base.

The invention will now be explained with reference to a drawing wherein:

FIG. 3 is a detail of apparatus for forming a radially outwardly inverted peripheral edge on a preformed lid by the known roll-forming method.

FIG. 4 is a detail of apparatus for forming an outwardly inverted peripheral edge by the method according to the invention.

FIG. 5 is a detail of the apparatus according to FIG. 4 to an enlarged scale, in the position in which the inverted edge has not yet been formed and FIG. 6 is a section corresponding to FIG. 5 in the position in which the inverted peripheral edge has been formed.

Figure 1:
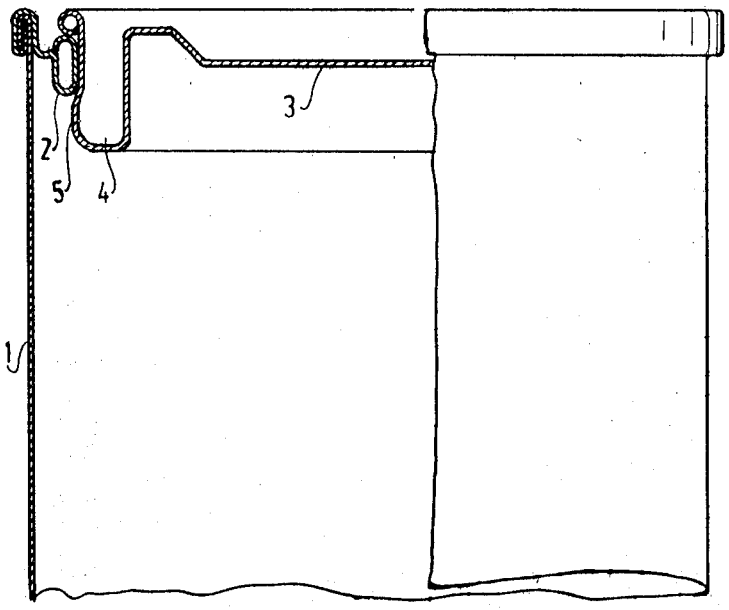
FIG. 1 is a partially fragmentary elevation of a tin closed by a lid having a radially outwardly inverted peripheral edge.

FIG. 1 shows a tin 1 with an edge 2, of which the most inward surface as considered radially co-operates with the outer surface of a metal lid 3. The latter has an axially deepened peripheral portion 4 with an outwardly inverted peripheral edge 5.

From FIG. 1 it will be apparent that the outwardly inverted peripheral edge 5 so co-operates with the edge 2 as to prevent undesirable release of the lid, e.g. in the event of the tin's falling.

Figure 2:
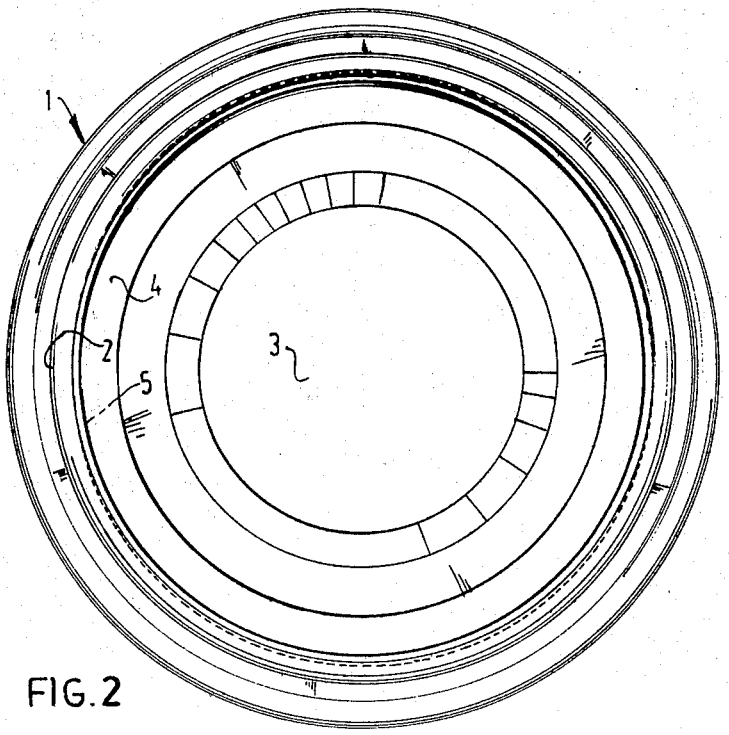
FIG. 2 is a plan view of the tin with the lid according to FIG. 1, the broken-lines illustrating the oval shape of a lid produced by the known technique.

FIG. 2 is a top plan view of the same situation as in FIG. 1. The most inwardly situated circle shows the fit of the lid inside the edge 2. A broken line shows the general shape of the fitting edge if the lid 3 is made by the known technique. FIG. 3 shows how this known method is performed. The pre-formed lid 3 is applied loosely to a mandrel 6. The latter is driven in a rotary movement about its centre-line. A roller 7, the peripheral shape of which corresponds to the outer peripheral shape of the mandrel, and rotating freely around its centre-line, is then pressed with force in the radial direction of the mandrel. In view of the matching shapes of the outer peripheries of the mandrel 6 and the roller 7, the peripheral edge is thus pressed inwards slightly, resulting in the shape of the outwardly inverted peripheral edge 5. It will be apparent that the initial diameter of the tin corresponds to the diameter of the outwardly inverted peripheral edge.

As will be apparent from FIG. 3, the lid is not in close contact with the mandrel over its entire surface. When the outer edge is pressed against the mandrel 6 by the roller 7, the axially deepened peripheral portion is completely loose on the inside in relation to the mandrel. The converse situation will occur on the other side situated transversely opposite, the lid thus pressing against the mandrel from within while the outer edge is completely free although the axially deepened peripheral portion will be completely loose from the mandrel there.

This roll-forming operation thus results in a product which does not adhere sufficiently to the specified tolerances.

FIG. 4 is a partially fragmentary view of a die consisting of four parts 8, 9, 10, 11. The three parts 8, 9, 10 are stationary during the actual forming operation and are shaped to engage a pre-formed lid 3 in closely fitting relationship. The lid is engaged except in the zone where the inverted peripheral edge 5 is to be formed and the inside of the axially deepend peripheral portion 4.

In the zone where the inverted peripheral edge 5 is to be formed the stationary part 8 of the die is formed with an annular groove 12 to receive the formed outwardly inverted peripheral edge 5.

FIG. 4 shows the last stage of operations, in which the movable part 11 of the die is pressed in the direction of the stationary part 9 to form the inverted peripheral edge 5 while the lid has not yet been released from the apparatus.

FIG. 5 is the detail V of FIG. 4 in a position in which the lid is held in tightly fitting relationship by the stationary die parts 8, 9, 10 prior to the forming operation by means of the movable part of the die, i.e. the axial plunger 11, which can be driven with force in the direction of the arrow. As is clear from FIG. 5, the base of the axially deepened peripheral portion 4 does not rest against the bottom portion of the part 9 of the die but has some clearance therefrom.

FIG. 6 is a similar view to FIG. 5 in the position in which the axial plunger 11 has moved with force in the direction of the arrow. As a result, the bottom portion of the peripheral part 8 is compelled to move in the direction of the only available space, i.e. the annular groove 12 in the stationary part 8 of the die.

As a result of the very close fit, the method described with reference to FIGS. 4, 5 and 6 in conjunction with the apparatus gives a lid, the relevant dimensions of which, and particularly the diameter of the outer surface, are no longer dependant on random uncontrollable factors. The resulting product is accurate within the dimensional tolerances.

It should be noted that the outwardly inverted peripheral edge 5 can be made in the required dimensions depending upon the axial and radial dimensions of the annular groove 12. The difference between the initial depth of the peripheral portion 4 and the corresponding dimensions of the stationary part 9 of the die should also be taken into account in this connection.

In the exemplified embodiment of FIGS. 4–6, the die part 8 is constructed as a unit. Ejection of the finished lid is obtained by moving the axial plunger 11 further after removal of part 9 of the die. A radial resilient movement of the inverted peripheral edge formed temporarily occurs in these conditions. Of course it could also be constructed from radially movable segments so that the punch 8 can be opened to release the formed lid.

The invention is not restricted to the performance of the method using the die parts illustrated in FIGS. 4 to 6. For example, it is not strictly necessary for the stationary part 9 of the die to extend over the entire flat portion of the lid. All that is required is that the inner wall of the deepened portion 4 and a portion of the outer wall thereof should be held in tightly fitting relationship.

I claim:

1. The method of forming a metal lid to close, circular tolerances, which comprises the steps of:

(a) forming a metal lid having an outer annular wall portion which is concentric with an axis which is perpendicular to the general plane of the lid, having an inner annular wall portion spaced radially inwardly from and parallel to said outer wall portion, having a U-shaped portion joining said wall portions at one end thereof, and having a central disc-like portion bridging across the other end of said inner wall portion;

(b) closely confining the metal lid of step (a) within a die assembly to preserve the concentricity of said wall portions and their parallelism and to provide clearance spaces only in a region circumferentially surrounding a portion of said outer wall portion at its juncture with said U-shaped portion and in a region between said wall portions opposite said U-shaped portions and, while the metal lid is so confined;

(c) permanently deforming said U-shaped portion to close said clearance opposite thereto and to bulge and permanently deform said portion of the outer wall portion into said circumferentially surrounding clearance therefor; and then (d) removing the so-deformed metal lid without further deformation to recover a finished metal lid having the circularity of the lid as formed in step (a).

* * * * *